US005696832A

United States Patent [19]

Sanders

[11] Patent Number: 5,696,832

[45] Date of Patent: Dec. 9, 1997

[54] APPARATUS FOR LIMITING AND DISPLAYING ELECTRICAL FADER LEVEL SIGNALS

[76] Inventor: Glenn Sanders, 235 Old Wood Rd., Franklin Lakes, N.J. 07417

[21] Appl. No.: 491,688

[22] Filed: Jun. 14, 1995

Related U.S. Application Data

[63] Continuation of Ser. No. 116,726, Sep. 3, 1993, abandoned.

[51] Int. Cl.[6] ..... H04R 29/00

[52] U.S. Cl. ..... 381/56; 381/58

[58] Field of Search ..... 381/56, 58, 59, 381/109, 119, 104; 345/35–40, 904, 211–213

[56] References Cited

U.S. PATENT DOCUMENTS

| | | | |
|---|---|---|---|
| 4,197,650 | 4/1980 | Bailey et al. | 345/40 |
| 4,528,501 | 7/1985 | Dorroujh et al. | 381/56 |
| 4,839,857 | 6/1989 | Mersiovsky et al. | 381/56 |
| 5,122,720 | 6/1992 | Martinson et al. | 381/109 |
| 5,239,458 | 8/1993 | Suzuki | 381/119 |
| 5,317,641 | 5/1994 | Yasuda et al. | 381/119 |
| 5,369,416 | 11/1994 | Haverty et al. | 345/35 |

*Primary Examiner*—Curtis Kuntz
*Assistant Examiner*—Ping W. Lee
*Attorney, Agent, or Firm*—Abelman, Frayne & Schwab

[57] ABSTRACT

Apparatus for limiting and displaying fader levels employing a display device provided with a linear bar graph display having a plurality of bar graph segments and having an input to which a display signal of variable value can be applied. The display signal has a value range with predetermined maximum and minimum values. The device responds to any value of the display signal to illuminate a corresponding segment. A fader mechanism is manually adjustable to produce a fader signal of variable value. The fader signal has a value range with maximum and minimum values which respectively exceed and fall below the corresponding maximum and minimum values of the display signal. A computer has an input at which the fader signal is applied. The computer stores the maximum and minimum values of the display signal and compares the value of the fader signal with the stored values to produce a display signal. The display signal has a value equal to the fader signal unaltered when the value of the fader signal falls within the range of the display signals; the display signal has its maximum value when the value of the fader signal is in excess of the maximum value of the display signal and has its minimum value when the value of the fader signal falls below the minimum value of the display signal. The display signal appears at an output of the computer is supplied to the input of the display device.

6 Claims, 1 Drawing Sheet

APPARATUS FOR LIMITING AND DISPLAYING ELECTRICAL FADER LEVEL SIGNALS

This application is a continuation application under 37 C.F.R. 1.62 of prior application Ser. No. 08/116,726, filed on Sep. 3, 1993, now abandoned.

BACKGROUND OF THE INVENTION

When the technique of audio mixing of signals is employed, it is desirable to set limits to the electrical range of a particular manually adjustable audio gain control known as a fader control and when necessary to change the limits. In known apparatus utilizing such a control, the minimum to maximum range of adjustment of the control is built into the controls and is not changed when the electrical limits are changed. The electrical limits are set by means independent of the positioning of the control. Consequently, it is necessary for an operator using equipment emplying the audio mixing technique to prevent the control from being so positioned as to cause the generation of electrical signals having values which exceed the selected electrical range.

The present invention is directed to apparatus which prevents the fader control from causing the production of electrical signals having values which exceed the selected electrical range. This apparatus also produces a display of signals generated in accordance with the fader control setting as long as the production of electrical signals do not exceed the selected electrical range and limits the generated signals to the selected electrical range when the fader control setting would otherwise cause the generation of signals falling outside of the selected electrical range.

SUMMARY OF THE INVENTION

In accordance with the principles of this invention, apparatus for limiting and displaying electrical fader levels utilizes display means provided with a linear bar graph display having a plurality of bar graph segments. The display means has an input to which a display signal of variable value can be applied. The display signal has a value range with predetermined maximum and minimum values. The display means responds to any value of the display signal supplied to the input of the display means to illuminate a corresponding segment.

The apparatus further utilizes fader means manually adjustable to produce a fader signal of variable value. The fader signal has a value range with maximum and minimum values which may respectively exceed and/or fall below the corresponding maximum and minimum values of the display signal.

The apparatus further utilizes computer means having an input at which the fader signal from the fader means is applied. The computer means has first means in which the maximum and minimum values of the display signal are stored. The computer means also has second means for comparing the value of the fader signal suppied to the computer means with said stored values to produce a display signal. The display signal has a value equal to the fader signal unaltered when the value of the fader signal falls within the range of the display signal. The display signal attains its maximum value when the value of the fader signal is in excess of the maximum value of the display signal. The display signal attains its minimum value when the value of the fader signal falls below the minimum value of the display signal. The display signal appears at an output of the computer means and is supplied to the input of the display means. Thus the value of the display signal displayed by the bar graph directly corresponds to the value of the fader signal when this value does not exceed the selected range of values of the display signal, and when the value of the fader signal exceeds and/or falls below the maximum or minimum value of the selected range, the value of the display signal is limited to the maximum and/or minimum value of the selected range and this limitation is displayed visually on the bar graph.

DETAILED DESCRIPTION OF PREFERRED EMBODIMENT

Figure 1:
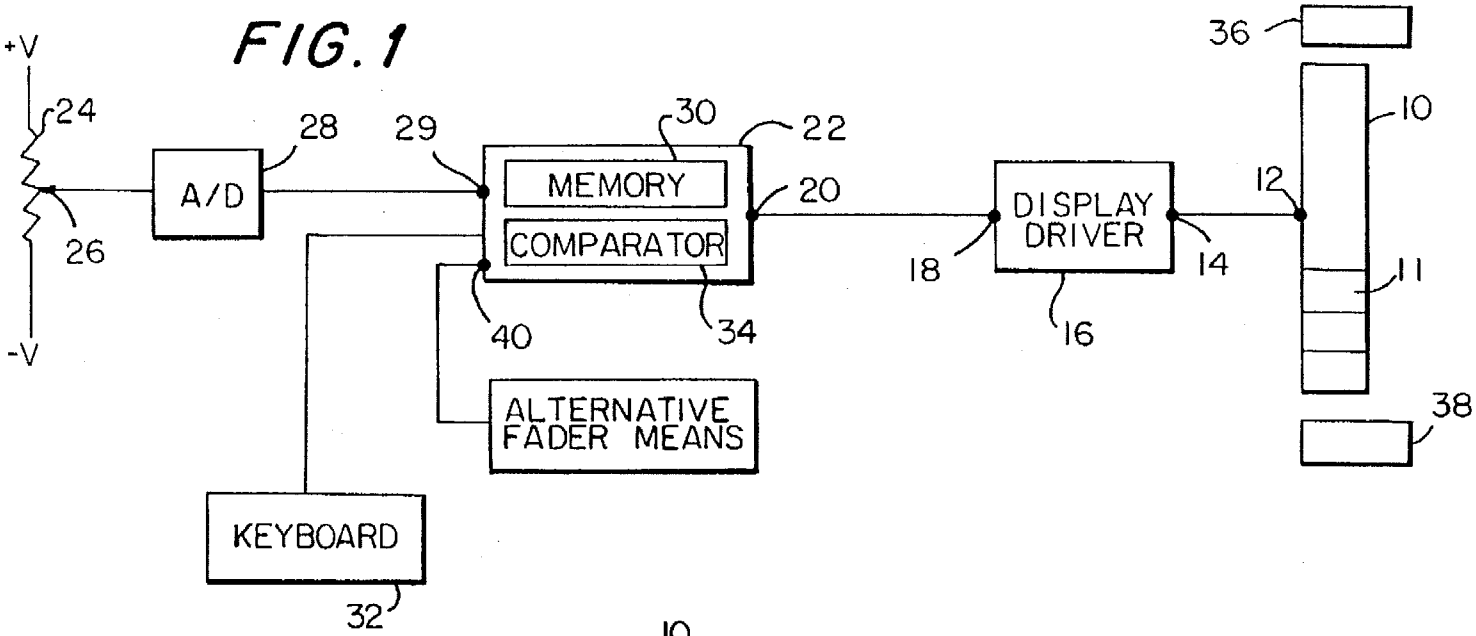
FIG. 1 is a block diagram of a preferred embodiment of the invention.

Referring first to FIG. 1, there is shown a known type of linear bar graph display 10 having a plurality of bar graph segments 11. Display 10 has an input 12 which is connected to the output 14 of a known display driver 16. Driver 16 receives at its input 18 a display signal of variable value which appears at the output 20 of a computer 22. The display signal has a value range with predetermined maximum and minimum values. This range can be set as explained below. Driver 16 responds to any value of the display signal supplied thereto to cause the display 10 to illuminate a corresponding segment.

Fader means manually adjustable to produce a fader signal of variable value can take the form of a potentiometer 24 with a manually movable arm 26 and electrically energized as shown. The position of the arm causes the production of an analog fader signal. The two extreme positions of the arm establish maximum and minimum values of the fader analog signal which can respectively exceed and/or fall below the corresponding maximum and minimum values of the display signal.

The analog fader signal is supplied to an analog/digital converter 28 which converts the analog fader signal to its digital equivalent and supplies the resultant digital fader signal to an input 29 of computer 22.

Computer 22 has first memory means 30 in which the maximum and minimum values of the display signal are stored. These values can be entered and/or changed in digital form by manual operation of a keyboard 32 connected via a second input to the computer.

Computer 22 has second comparator means 34 for comparing the value of the fader signal suppied to the computer with the values stored in the memory to produce a digital display signal having a value equal to the digital fader signal unaltered when the value of the fader signal falls within the range of the display signals; to produce a display signal of maximum value when the value of the fader signal is in excess of the maximum value of the display signal; and to produce a display signal of minimum value when the value of the fader signal falls below the minimum value of the display signal. The display signal appears at the output of the computer is supplied to the input of the display driver.

Maximum value lamp 36 is disposed adjacent one end of the bar graph and minimum value lamp 38 is disposed adjacent the opposite end of the graph. These lamps are actuated by the signal supplied at the output of the driver. The lamp 36 is illuminated when the display signal attains its maximum value and is otherwise dark. The lamp 38 is illuminated when the display signal attains its minimum value value and is otherwise dark.

Alternative fader means such as an optical encoder can be used to supply a digital fader signal to an additional input 40 of the computer.

Figure 2:
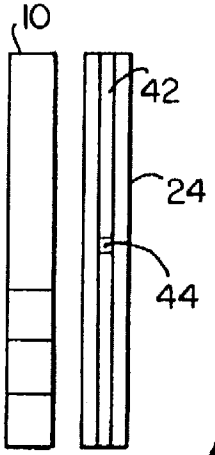
FIG. 2 is a detail view of a portion of the structure shown in FIG. 1.

As shown in FIG. 2, the apparatus of FIG. 1 can have a slot 42 disposed adjacent and parallel to the bar graph display. A lever 44 slidable back and forth in slot 42 can be connected to the arm 26 of potentiometer 24. In this manner, the position of said lever when the display signal is equal to the unaltered fader signal can be essentially aligned with the corresponding illuminated segment. Movement of the lever beyond the position corresponding to that of the maximum value of the display signal or beyond the position corresponding to that of the minimum value of the display signal will not change the position of the corresponding illuminated segment, thereby providing an immediate visual showing of the misalignment of the lever position with the illuminated segment.

While the invention has been described and shown with particular emphasis on the preferred embodiment, the protection sought is to be limited only by the terms of the claims which follow.

What is claimed is:

1. Apparatus for adjustably limiting and displaying fader levels comprising:

display means provided with a linear bar graph display having a plurality of bar segments and having an input to which a display signal of variable value can be applied, the display signal having a first value range extending between predetermined first maximum and first minimum values, the display means responding to any value of the display signal supplied to the input of the display means to illuminate a corresponding segment;

adjustable signal limiting means for selectively changing said first maximum and first minimum values;

fader means manually adjustable to produce a fader signal of variable value, the fader signal having a second value range extending between a second maximum and a second minimum value;

said second maximum value output of the fader means capable of exceeding and being maintained above said first maximum value, and said second minimum value output of the fader means capable of falling and being maintained below said first minimum value, whereby said adjustable signal limiting means limits said first value range to a lesser range within the greater second value range of fader signals;

computer means having a first input at which the fader signal from the fader means is applied, and a second input connected to said adjustable signal limiting means for entering the selected first value range, the computer having storage means in which the first maximum and first minimum values of the display signal are stored, comparative means for comparing the value of the fader signal supplied to the computer means with said stored values to produce said display signal having a value (a) equal to said first maximum value when the fader signal at said first input is equal to or exceeds said first maximum value, (b) equal to said first minimum value when the fader signal at said first input is equal to or less than said first minimum value, or (c) equal to the fader signal when the fader signal at said first input is between said first minimum and first maximum values, wherein said display signal has a value equal to the fader signal applied to said first input when the value of the fader signal falls within the first predetermined minimum and maximum range of the display signals, to produce said display signal of the first maximum value when the value of the fader signal is applied to said first input between said first and second maximum values and thereby in excess of the first maximum value of the display signal and to produce said display signal of the first minimum value when the value of the fader signal applied to said first input falls is between said first and second minimum values and thereby falls below the first minimum value of the display signal, the display signal appearing at an output of the computer means being limited by said adjustable signal limiting means to said first value range between said first minimum and first maximum values irrespective of the value of the fader signal supplied by said fader means and being applied to the first input of the computer;

said fader means and said display means both extending in the same longitudinal direction, in side-by-side parallel arrangement;

said fader means including a manually movable lever, movable in said longitudinal direction, between said second minimum and second maximum values;

the position of said manually movable lever being (a) aligned with the value of the display signal level when said fader signal is within said first value range, and (b) horizontally beyond the value of the display signal level when said fader signal is between said first value range and second value range; and the horizontal misalignment of said manually movable lever and the value of the display signal level providing a deviation signal means for indicating when the value of the fader signal is outside of the range between said first minimum and first maximum values.

2. The apparatus of claim 1, wherein said adjustable signal limiting means comprises a keyboard to selectively set and change first value range to corresponding values in said display means and computer storage means.

3. The apparatus of claim 1 wherein the extent of misalignment between said manually movable lever and the value of the display signal provides level a deviation signal which indicates the magnitude of the deviation between the fader signal applied to said computer first input and the extent it is outside of said first value range.

4. Apparatus of claim 1 wherein the fader signal values and the display signal signal values are produced in digital form.

5. Apparatus of claim 4 wherein the fader means produces a fader signal in analog form, the analog signal being converted into digital form prior to being supplied to said second means.

6. Apparatus of claim 1 wherein the display means includes a display driver disposed between the display and the computer means and high and low level lamps, the high level lamp being lit when the display signal attains its maximum value, the low level lamp being lit when the display signal attains its minimum value, the lamps otherwise being dark.

* * * * *